US007794271B2

(12) United States Patent
Wu et al.

(10) Patent No.: US 7,794,271 B2
(45) Date of Patent: Sep. 14, 2010

(54) CABLE CONNECTOR ASSEMBLY WITH WIRE MANAGEMENT MEMBER THEREOF

(75) Inventors: Lin Wu, Kunshan (CN); David Tso-Chin Ko, Cypress, CA (US); Wei-Ya Cheng, Kunshan (CN); Hai-Wei Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/154,451

(22) Filed: May 23, 2008

(65) Prior Publication Data

US 2008/0293292 A1 Nov. 27, 2008

(30) Foreign Application Priority Data

May 23, 2007 (CN) ..... 2007 2 0039148

(51) Int. Cl.
*H01R 12/24* (2006.01)

(52) U.S. Cl. ..... 439/497; 439/607.41

(58) Field of Classification Search ..... 439/497, 439/579, 607.41, 607.42, 607.47, 607.49
See application file for complete search history.

(56) References Cited

U.S. PATENT DOCUMENTS

| | | | | |
|---|---|---|---|---|
| 6,039,611 | A | 3/2000 | Yang | |
| 6,123,582 | A | 9/2000 | Ko | |
| 6,139,363 | A | 10/2000 | Ko | |
| 6,206,722 | B1 | 3/2001 | Ko | |
| 6,273,753 | B1 | 8/2001 | Ko | |
| 6,305,978 | B1 | 10/2001 | Ko | |
| 6,305,979 | B1 | 10/2001 | Ko | |
| 6,338,652 | B1 | 1/2002 | Ko | |
| 6,648,668 | B1 * | 11/2003 | Ko | 439/353 |
| 6,659,791 | B1 * | 12/2003 | Ko et al. | 439/353 |
| 6,685,495 | B1 * | 2/2004 | Ko | 439/353 |
| 6,793,527 | B2 * | 9/2004 | Noro | 439/579 |
| 6,802,744 | B2 | 10/2004 | Chiang | |
| 7,052,327 | B2 * | 5/2006 | Ko | 439/660 |
| 7,137,842 | B2 * | 11/2006 | Ko | 439/358 |
| 7,189,105 | B2 * | 3/2007 | Takaku et al. | 439/497 |
| 7,223,120 | B2 * | 5/2007 | Ko | 439/492 |
| 7,229,316 | B2 * | 6/2007 | Takaku et al. | 439/607.56 |
| 7,467,969 | B2 * | 12/2008 | Liu et al. | 439/493 |
| 7,530,839 | B1 * | 5/2009 | Lee | 439/496 |
| 2008/0280479 | A1 * | 11/2008 | Wu et al. | 439/358 |

* cited by examiner

*Primary Examiner*—Hae Moon Hyeon
(74) *Attorney, Agent, or Firm*—Wei Te Chung; Andrew C. Cheng; Ming Chieh Chang

(57) ABSTRACT

A cable connector assembly includes an insulator (1), a plurality of conductive terminals (2) held in the insulator, a plurality of wires (4), a spacer (3) and a metal shell (6, 7). Each wire comprises an inner conductor (41) conductively connecting with the terminals, and at least one of the wires is a coaxial cable (4*a*) which has a shielding braid layer (43) enclosing the corresponding inner conductor. The spacer is mounted on the insulator and used for supporting the wires. The spacer comprises an inner surface with thereof a plurality of slots (31) for receiving the responding wires and an outer surface opposite to the inner surface, and a through-hole (32) is formed through the inner and outer surfaces. The metal shell is mounted on and covers the insulator. The spring finger (75) is formed integrate with the metal shell and extends inwards, and the spring finger passes through the through-hole to electrically connect with the shielding braid of the coaxial cable.

8 Claims, 6 Drawing Sheets

CABLE CONNECTOR ASSEMBLY WITH WIRE MANAGEMENT MEMBER THEREOF

BACKGROUND OF THE INVENTION

1. Field of the Invention

This invention generally relates to a cable connector assembly, and more particularly, to a cable connector assembly with an improved wire management member for managing wires.

2. Description of the Prior Art

U.S. Pat. No. 6,802,744 discloses an electric cable connector. The cable connector includes a connector housing, a cable, and a wire management member. The connector housing includes a plurality of terminals, the terminals each having a tail extending out of one end of the connector housing for electrically soldering to respective wires of the cable. The wire management member is joined to the connector housing, and includes a plurality of terminal grooves adapted to receive the tail of each of the terminals, thereby preventing the tail of each terminal from being suspended in the air, and a plurality of wire grooves adapted to receive the wires of the cable for enabling the wires to be respectively positively soldered to the tail of each of the terminals. Positioning rods are also included on the wire management member to be received within cavities in the connector housing. However, a pair of insulative cases are usually needed to cover the tails of the terminals and the wire management member. Therefore, the dimension of the cable connector is to become large. Moreover, the wire management member is not effective to be applied for coaxial cables, because it doesn't provide a grounding path for shielding braids of the coaxial cables.

Hence, an improved cable connector assembly is desired to overcome the above problems.

BRIEF SUMMARY OF THE INVENTION

It is an object of the present invention to provide a cable connector assembly which provides a wire management member with a grounding path.

In order to attain the object above, a cable connector assembly according to the present invention comprises an insulator, a plurality of conductive terminals held in the insulator, a plurality of wires, a spacer and a metal shell. Each wire comprises an inner conductor conductively connecting with the terminals, and at least one of the wires is a coaxial cable which has a shielding braid enclosing the corresponding inner conductor. The spacer is mounted on the insulator and used for supporting the wires. The spacer comprises an inner surface with thereof a plurality of slots for receiving the responding wires and an outer surface opposite to the inner surface, and a through-hole is formed through the inner and outer surfaces. The metal shell is mounted on and covers the insulator. The spring finger is formed integrate with the metal shell and extends inwards, and the spring finger passes through the through-hole to electrically connect with the shielding braid of the coaxial cable.

It is another object of the present invention to provide a cable connector assembly which provides a wire management member with small dimension.

In order to attain the object above, a cable connector assembly according to the present invention comprises an insulator, a plurality of conductive terminals, a plurality of wires, a spacer and a metal shell. The insulator comprises a tongue plate holding the terminals therein and a pair of arm portions extending backwards from both sides of the tongue plate, and the pair of arm portions extend beyond the tongue plate to form a space between the pair of the arm portions. The plurality of wires electrically connect with the corresponding terminals. The spacer is mounted on the insulator and received in said space of the insulator, and the spacer forms on the top surface thereof a plurality of slots for receiving the plurality of wires. The metal shell is mounted on the insulator and covers the slots of the spacer.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
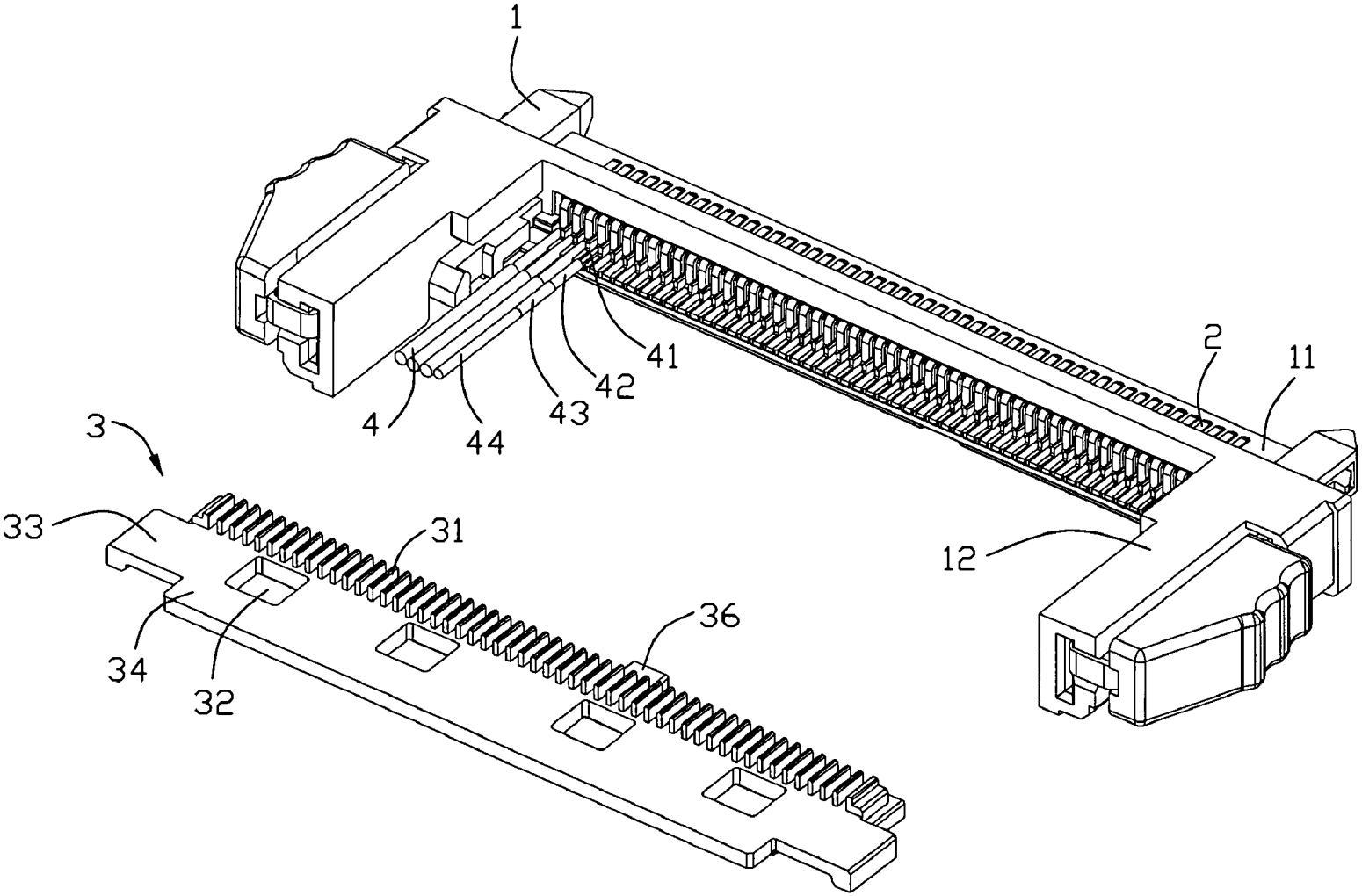
FIG. 1. is a partially assembly view of a cable connector assembly in accordance with the present invention.

Reference will now be made in detail to the preferred embodiment of the present invention.

Please referring to FIGS. 1-6, a cable connector assembly according to the present invention is used in a Liquid Crystal Display (LCD) TV, and comprises an insulator 1, a plurality of conductive terminals 2 held in the insulator 1, a plurality of wires 4 electrically connecting with the corresponding terminals 2, a spacer 3 mounted on the insulator 1 for managing the wires 4, and a metal shell covering the insulator 1. The metal shell comprises opposite top and bottom shells 6 and 7.

Figure 2:
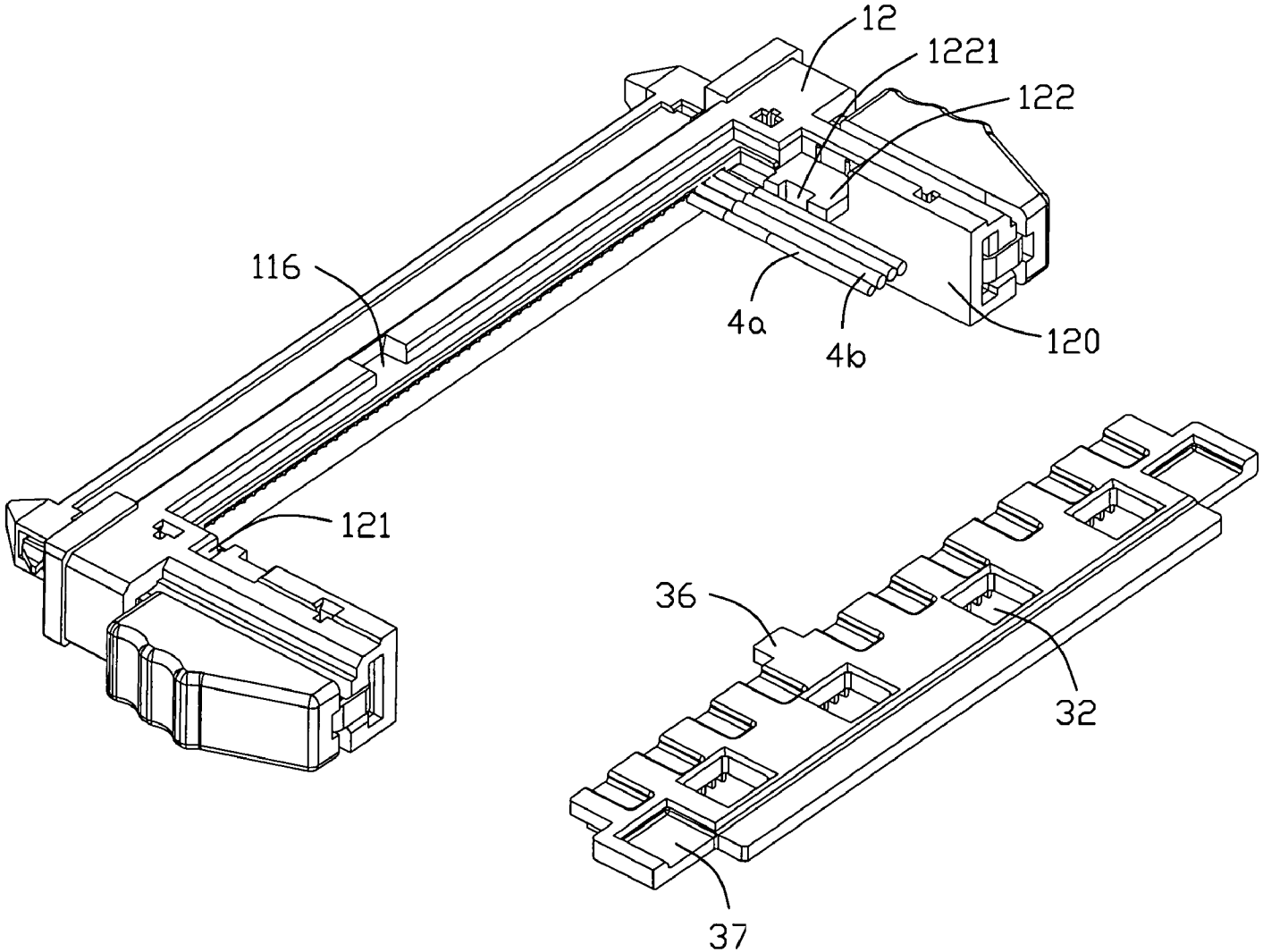
FIG. 2 is a view similar to FIG. 1, but viewed from another aspect.
Figure 3:
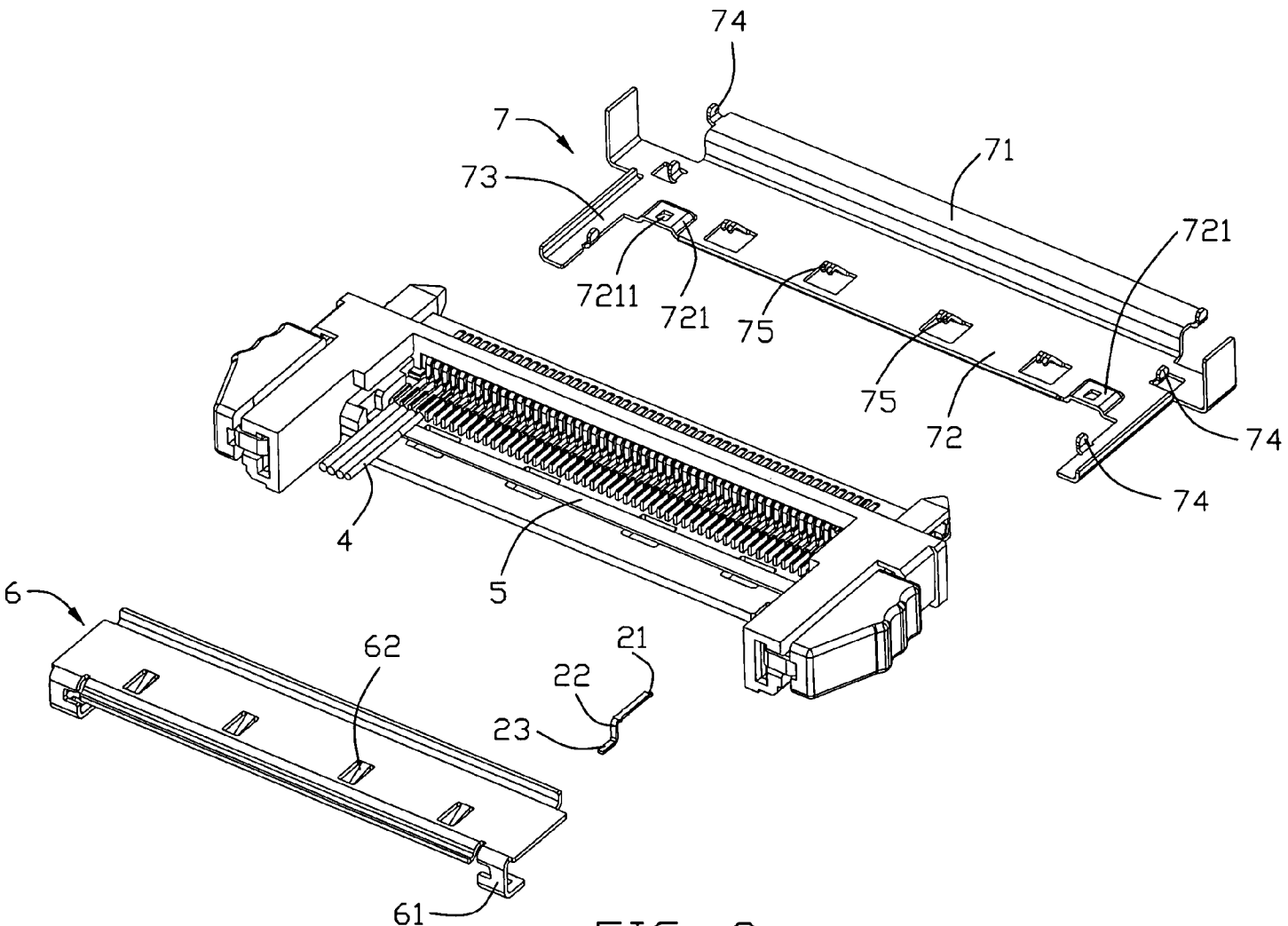
FIG. 3 is an exploded, perspective view of the cable connector assembly.
Figure 4:
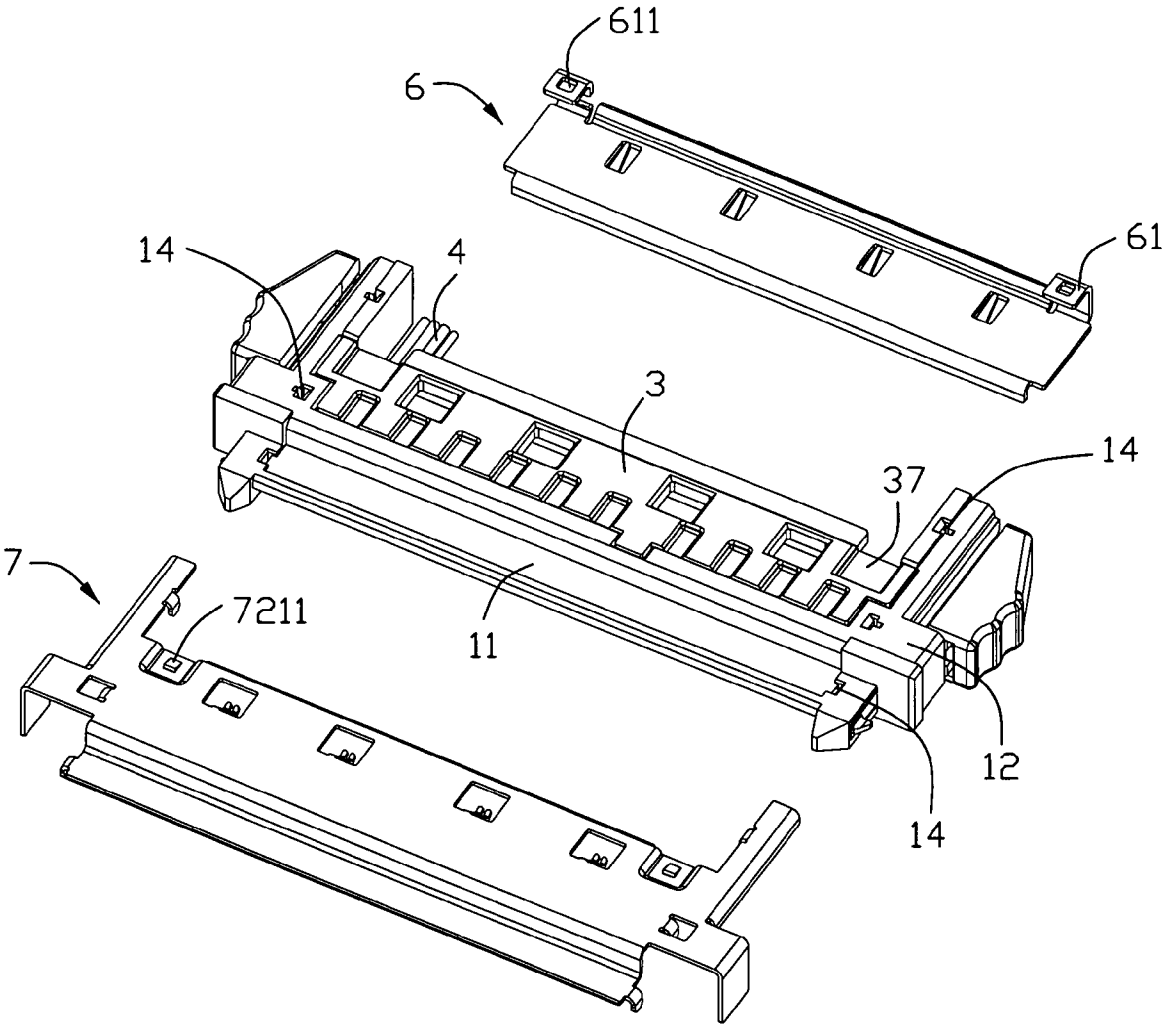
FIG. 4 is a view similar to FIG. 3, but viewed from another aspect.
Figure 5:
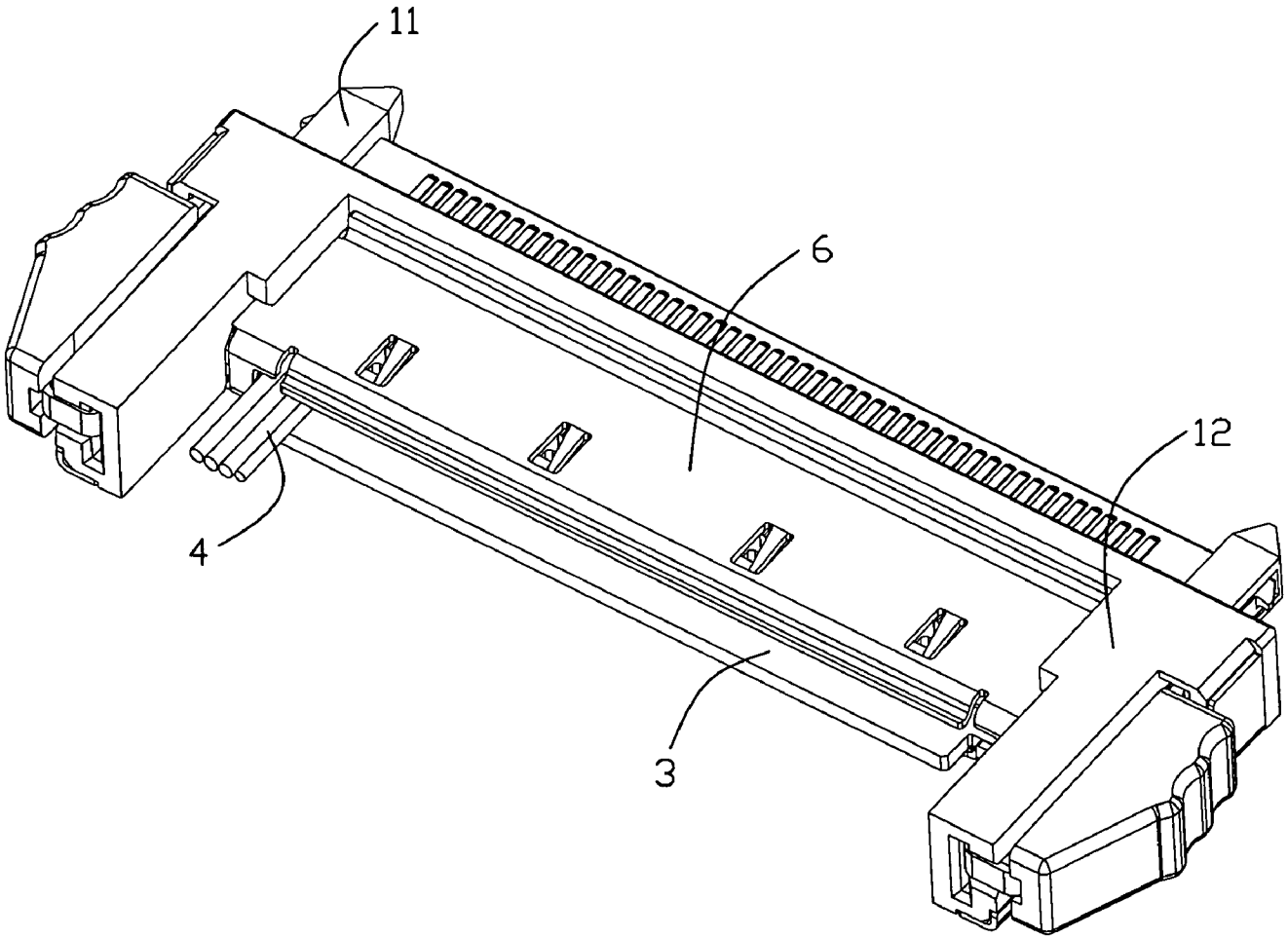
FIG. 5 is an assembled view of the cable connector assembly.

FIGS. 1-2 show a partially assembled view of the cable connector assembly according to the present invention before a spacer 3 is mounted thereon; FIGS. 3-4 show an assembled view of the cable connector assembly.

The insulator 1 comprises a tongue plate 11 with a plurality of terminals 2 thereof and a pair of arm portions 12 extending backwards from the tongue plate 11. Each arm portion 12 forms on its lateral side a space to accommodate a latch (not labeled) which is used to maintain the connection between the insulator 1 and a complementary connector. The tongue plate 11 has a plurality of passageways (not labeled) to receive the conductive terminals 2. Each terminal 2 comprises a mating portion 21 at the front thereof, a step portion 22 in the middle, and a tail portion 23 extending beyond the tongue plate 11 for contacting the wire 4.

The spacer 3 comprises a plurality of slots 31 used for receiving and managing the wires 4, four through-holes 32 extending through top and bottom surfaces of the spacer 3 and disposed at rear of the slots 31, and a supporting board 34 at rear of the through-holes 32 for supporting the wires 4. A pair of protrusion tabs 33 are formed at opposite sides of the spacer 3, and a pair of recesses 121 are formed on the arm portions 12 of the insulator 1 to receive the protrusion tabs 33. The spacer 3 forms a protrusion 36 in the right thereof, and a notch 116 is recessed in the tongue plate 11 of the insulator 1 for receiving the protrusion 36.

The recesses 121 opens backwards and inwards so the spacer is able to be mounted along bottom-to-top direction. A top wall 122 formed in each recess 121 and the bottom shell 7 are to hold the spacer therebetween. The top walls 122 extend inwards beyond inner walls 120 of the arm portions 12 and form a pair of apertures 1221 to receive a grounding bar 5.

The wires 4 include a number of signal wires 4*a* for transmitting signal and a number of power wires 4*b* for transmitting power. Each power wire 4*b* includes an internal conductor (not labeled) and an insulative jacket (not labeled) enclosing the internal conductor. Each signal wire 4*a* includes a metal shielding braid layer 43, an inner conductor 41, an inner insulation layer 42 disposed between the inner conductor 41 and the metal shielding braid layer 43, and outer insulation layer 44 disposed at the outermost thereof.

Please referring to FIG. 3, the spacer 3 is mounted on the insulator 1, with the slots 31 of the spacer 3 communicating with the corresponding passageways of the insulator 1 so that the terminals 2 received in the passageways can be easily soldered to the wires 4 received in the slots 31. The grounding bar 5 is secure to the insulator 1 only with thereof two ends respectively received in receiving holes 1221 which are formed on the top wall 122 of the insulator 1. Thereafter, the wires 4 are mounted on the spacer 3, with the inner conductors of the wires 4 contacting the corresponding terminals 2 and the wires spaced from each other. The metal shielding braid layers 43 of the signal wires 4*a*are abutting against and soldered to only one face of the grounding bar 5, thereby all the metal shielding braid layers electrically connect with each other.

Before the wires 4 are mounted, the bottom shell 7 is assembled on the insulator 2 to support the spacer 3. The bottom shell comprises a base 71 covering the insulator 2, a rear plate 72 extending from the base for engaging with the spacer 3, and a pair of arm plates 73 covering the pair of arm portion 12. A plurality of holding legs 74 are formed integrally with the base 71 and arm plates 73, and a plurality of holding holes 14 are formed with the insulator 1 to engage with the corresponding holding legs for holding the bottom shell 7. The rear plate 72 forms a plurality of spring fingers 75 through shearing and bending. The spring finger 75 pass through the through-holes 32 of the spacer 3 and abut against the grounding bar 5 to electrically connect with the metal shielding braid layer 43.

In the embodiment of the invention, by setting up a separate spacer 3 it makes the structure of the insulator 1 greatly simplified. At the same time, through-holes 32 of the spacer 3 is useful for the spring finger 75 of the metal shell 7 to electrically connect with the shielding braid 43 of the wires 4.

Finally, the top metal shell 6 is assembled on the insulator 1 and covers the slots 31 of the spacer 3 to prevent the tail 23 of the terminals 2 and the bare inner conductors 41 of the wires 4 exposed outside.

The rear plate 72 forms a pair of protrusion tabs 721 near the arm plates 73, and the spacer 3 forms a pair of grooves 37 to receive the protrusion tabs 721. A spring tab 7211 is formed in the center of each protrusion tab 721 through shearing and bending. The top shell 6 forms at the rear end a pair of U-shaped arms 61 with a pair of holes 611 thereof through bending and shearing, and the arms engages with the protrusion tabs 721 with the holes 611 receiving the spring tabs 7211.

Figure 6:
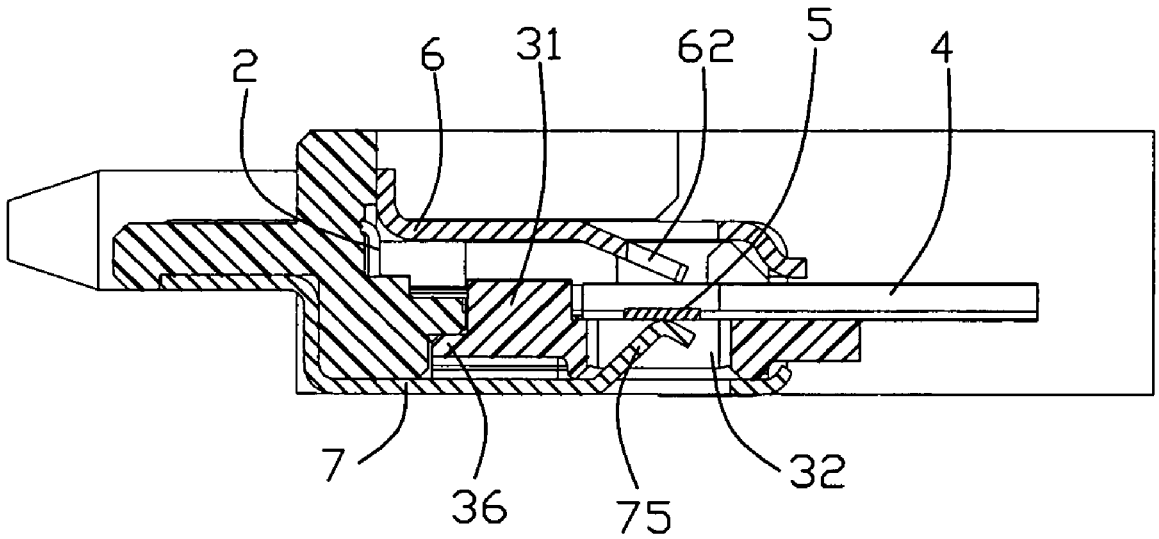
FIG. 6 is a cutaway view of the cable connector assembly shown in FIG. 5.

The top metal shell 6 forms a plurality of spring fingers 62 through shearing and bending, and the spring fingers 62 abut against the metal shielding braid layers 43 of the wire 4, as shown in FIG. 6, thereby the top and bottom shell 6 and 7, and the metal shielding braid layer 43 electrically connecting with each other. Moreover, That the spring fingers 62 are pressed upon the wires 4 can make the wires 4 in order.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable connector assembly comprising:

an insulative housing extending along a longitudinal direction and defining a plurality of passageways extending along a front-to-back direction perpendicular to said longitudinal direction;

a plurality of contacts disposed in the corresponding passageways, respectively;

a plurality of wires each defining an inner conductor, an inner insulator, an outer conductor and an outer insulator in sequence, said inner conductor being mechanically and electrically connected to the corresponding contacts, respectively;

an insulative spacer discrete from but assembled to the housing and defining a plurality of slots each receiving the corresponding wires;

a grounding bar being assembled to the housing and sandwiched between the spacer and the outer conductors of said wires; and a metallic shell assembled to the housing and covering said spacer with a plurality of spring arms extending through corresponding through holes in the spacer to 55 mechanically and electrically contact the grounding bar, wherein said grounding bar is secured to the housing only at two opposite ends of said grounding bar, and said outer conductors abut against and are soldered to only one face of said grounding bar.

2. The cable connector assembly as claimed in claim 1, wherein the slots receive the inner insulators of the corresponding wires, respectively.

3. The cable connector assembly as claimed in claim 1, wherein the housing includes a plurality of slits in alignment with the corresponding slots in said front-to-back direction, each of said slits receiving the corresponding contact and the inner conductor of the corresponding wires therein.

4. The cable connector assembly as claimed in claim 1, wherein said spacer defines a protrusion which couples to a notch in the housing for orientation consideration during assembling the spacer to the housing.

5. The cable connector assembly as claimed in claim 1, further including another metallic shell covering said wires opposite to said shell, and said another shell includes a plurality of spring fingers abutting against the outer conductors of the corresponding wires.

6. The cable connector assembly as claimed in claim 5, wherein said spring fingers are aligned with the corresponding spring arms, respectively, in a vertical direction perpendicular to the front-to-back direction and said longitudinal direction.

7. The cable connector assembly as claimed in claim 1, wherein the housing further includes a pair of arm portions extending rearwardly at two opposite sides thereof to form a space therebetween in which only the spacer and the wires are received therein.

8. The cable connector assembly as claimed in claim 7, wherein said spacer extends rearwardly beyond the shell while still being located within said space.

* * * * *